US005788874A

United States Patent [19]

Tucker, Jr.

[11] Patent Number: 5,788,874

[45] Date of Patent: Aug. 4, 1998

[54] LEAK RESISTANT HINGE FOR USE IN CONCRETE STRUCTURE FABRICATION

[76] Inventor: Bascom Murray Tucker, Jr., P.O. Box 492810, Leesburg, Fla. 34749-2810

[21] Appl. No.: 619,366

[22] Filed: Mar. 21, 1996

[51] Int. Cl.[6] ..... B28B 7/30

[52] U.S. Cl. ..... 249/180; 249/178; 249/181; 249/185; 16/221; 16/223; 16/250; 16/387

[58] Field of Search ..... 249/152, 178, 249/180, 181, 185; 16/221, 223, 250, 387

[56] References Cited

U.S. PATENT DOCUMENTS

| | | | |
|---|---|---|---|
| 1,363,651 | 12/1920 | Hutchins | 249/152 |
| 2,504,635 | 4/1950 | Bradley | 16/223 |
| 3,815,864 | 6/1974 | Loeber | 249/152 |
| 3,934,808 | 1/1976 | Aizawa | 249/152 |
| 3,990,673 | 11/1976 | Jones et al. | 249/152 |

*Primary Examiner*—David W. Wu
*Attorney, Agent, or Firm*—James H. Beusse

[57] ABSTRACT

A leak resistant hinge is provided for pivotally connecting adjacent concrete form sections to permit angular adjustment and movement of the form sections. The hinge includes first and second L-shaped hinge brackets which pivot about a pivot member to which both brackets are mounted. A gasket member is situated on the exterior of the first and second hinge brackets to seal the hinge while simultaneously permitting the first and second hinge brackets to pivot about the pivot member. Each hinge bracket is mountable to a respective adjacent concrete form section to permit adjacent form sections to pivot as needed to obtain the desired concrete form configuration.

9 Claims, 4 Drawing Sheets

LEAK RESISTANT HINGE FOR USE IN CONCRETE STRUCTURE FABRICATION

BACKGROUND OF THE INVENTION

This invention relates in general to apparatus for use in the formation of concrete structures and, more particularly, to a leak resistant hinge for use in the formation of such concrete structures.

The process of forming concrete structures typically involves the placement of forms in a predetermined location and configuration. Once the forms are properly located, uncured or so-called "green" concrete is poured into the forms. The green concrete cures and hardens to take on the geometry of the surrounding forms. Typically, the forms are constructed of multiple sections to allow the forms to be removed or released when the concrete has set. In many forms, the form sections are connected through hinges which allow the sections to pivot at the hinges for removal without separation. It is important that locations on the forms where one form section is hinged to another form section be liquid-tight to prevent concrete from seeping into the hinge. Such seepage is undesirable since it degrades product quality at the hinge and also damages and inhibits proper operation of the hinge. This type of leakage is clearly not desirable.

In the case of internal forms, movement of joints between form sections can be used to make the form smaller to permit removal of the concrete product. However, seepage into the mechanical joints and hinge assemblies interferes with operation of the joint and hinge requiring a user to beat on the hinge with a hammer or other object to break the cement loose and allow movement at the joint. Alternately, the joint may be forced loose also resulting in damage. Accordingly, it is desirable to provide a method and apparatus for preventing seepage of cementitious material into hinge joints in a concrete form.

SUMMARY OF THE INVENTION

Accordingly, one object of the present invention is to provide water-tight hinges for use at the joint between adjacent concrete form sections.

Another object of the present invention is to provide a hinge for a concrete form which prevents concrete from seeping through the hinge.

Another object of the present invention is to provide a hinge which permits movement and angular adjustment of the form section which are attached to the hinge.

Yet another object of the present invention is to provide a hinge for use in a concrete form wherein the hinge has a low cost of manufacture.

Still another object of the present invention is to provide a hinge for use in a concrete form wherein the hinge requires little maintenance.

In accordance with one embodiment of the present invention, a leak resistant hinge is provided which includes a pivot member. The hinge further includes a first hinge bracket having a first substantially L-shaped backing plate and first and second side hinge members. The first and second side hinge members are situated in spaced apart relationship and are connected to the first backing plate. The first and second side hinge members include respective holes which are pivotally connected to the pivot member. The first backing plate includes an interior surface and an exterior surface. The hinge also includes a second hinge bracket having a second substantially L-shaped backing plate and third and fourth side hinge members. The third and fourth side hinge members are situated in spaced apart relationship and are connected to the second backing plate. The third and fourth side hinge members include respective holes which are pivotally connected to the pivot member. The second backing plate includes an interior surface and an exterior surface. The hinge still further includes a gasket member situated abutting the exterior surface of the first backing plate and the exterior surface of the second backing plate, such that the gasket member flexes adjacent the pivot member as the first and second hinge brackets rotate about the pivot member while the gasket seals the hinge from moisture penetration.

BRIEF DESCRIPTION OF THE DRAWINGS

The features of the invention believed to be novel are specifically set forth in the appended claims. However, the invention itself, both as to its structure and method of operation, may best be understood by referring to the following description and accompanying drawings.

DETAILED DESCRIPTION OF THE INVENTION

Figure 1:
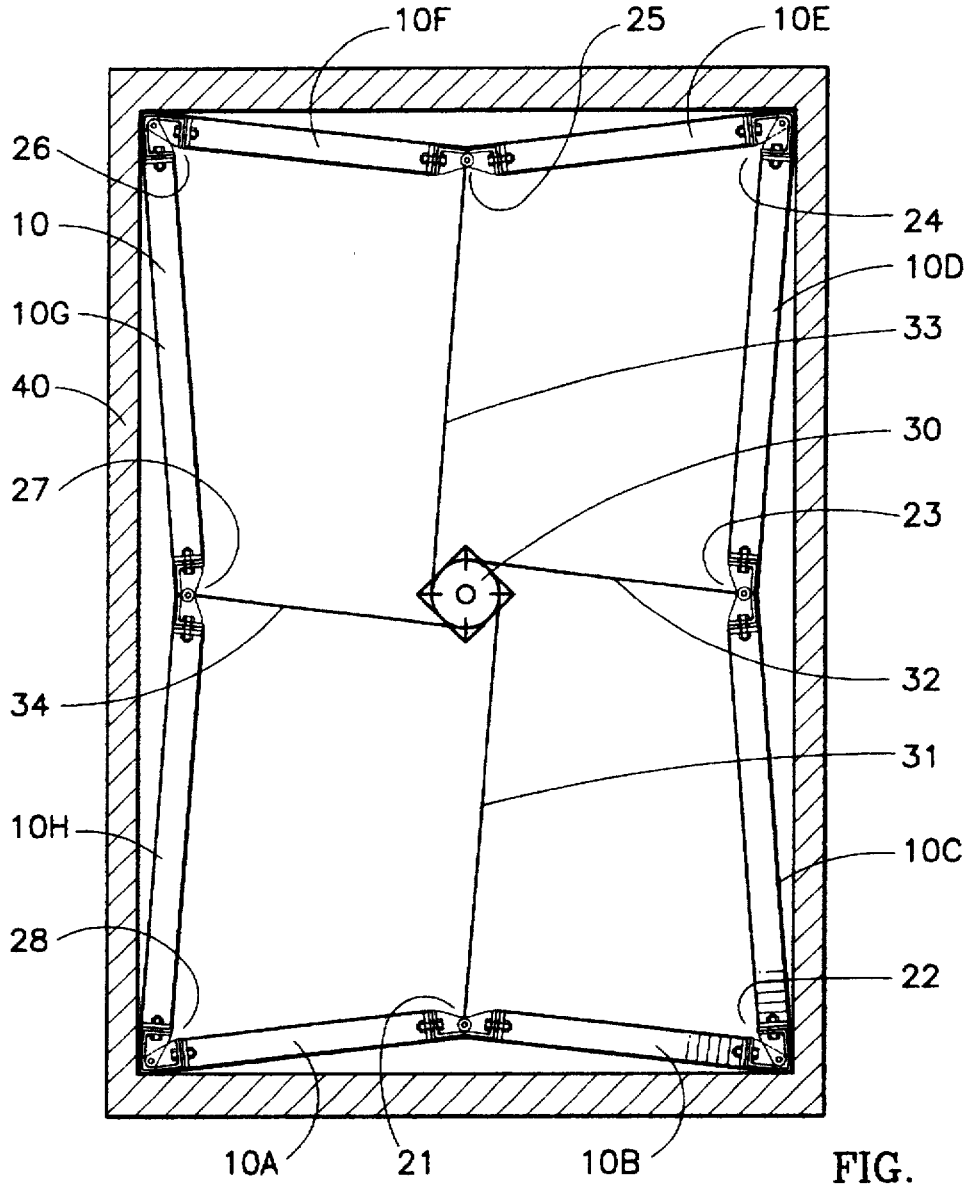
FIG. 1 is a top view of an internal form assembly employing the disclosed hinge showing the assembly in a collapsed position.
Figure 2:
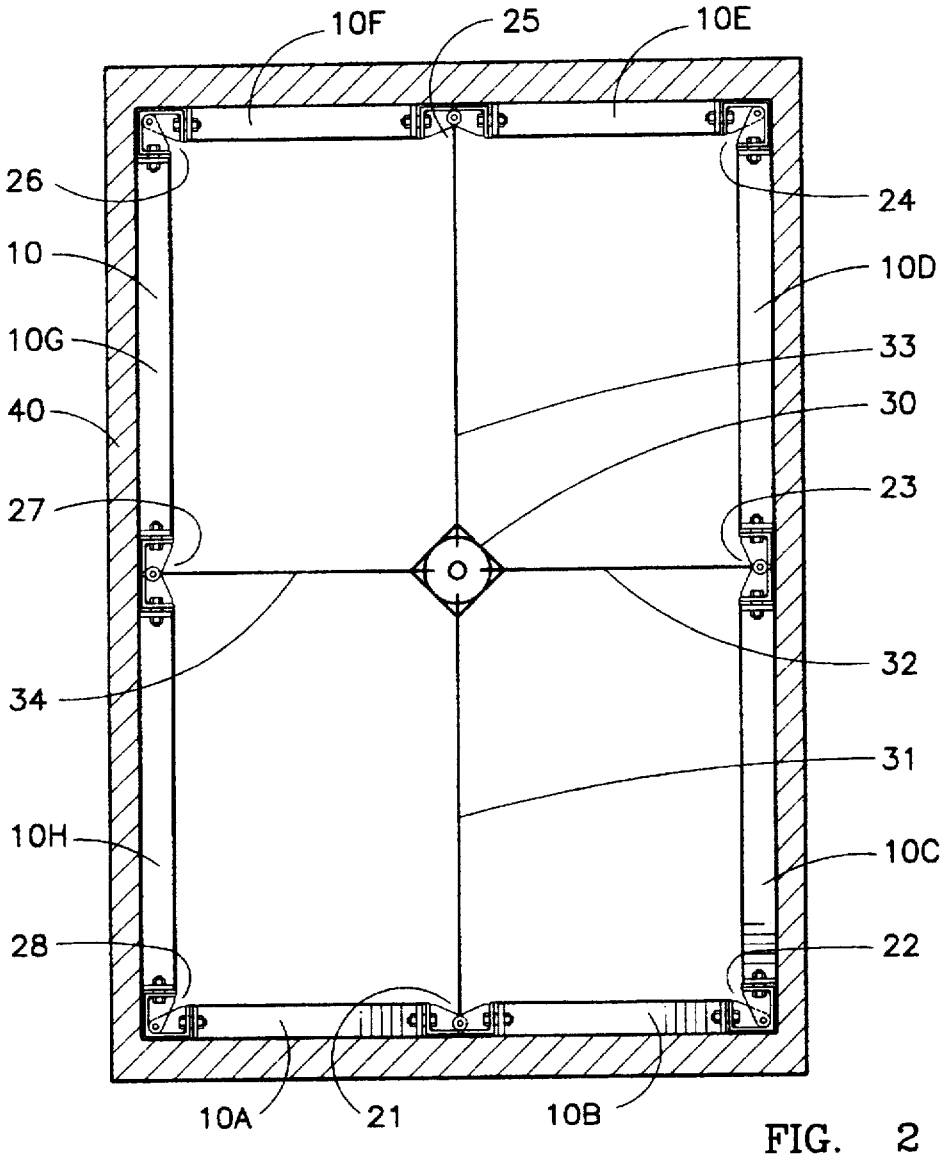
FIG. 2 is a top view of an internal form assembly employing the disclosed hinge showing the assembly in a locked position

FIG. 1 is a top view of an internal form assembly 10 shown in a collapsed position. Form assembly 10 includes form sections or panels 10A, 10B, 10C, 10D, 10E, 10F, 10G and 10H which are coupled together by respective water tight hinges 21, 22, 23, 24, 25, 26, 27 and 28. A rotary member 30 is coupled by respective connecting rods 31, 32, 33 and 34 to hinges 21, 23, 25 and 27. When rotary member 30 is rotated in the counterclockwise direction, connecting rods 31, 32, 33 and 34 pull inwardly on hinges 21, 23, 25 and 27 thus collapsing form assembly 10 and making it smaller as shown in FIG. 1. However, when rotary member 30 is rotated in the clockwise direction, connecting rods 31, 32, 33 and 34 push outwardly on hinges 21, 23, 25 and 27 thus locking the panels of form assembly 10 in position as shown in FIG. 2. Concrete is then poured around the locked form assembly 10 of FIG. 2 to form a concrete box 40. (An external fixed form, not shown, defines the outer periphery of the concrete box 40.) When concrete box 40 is cured and hardened, rotating member 30 is again rotated counterclockwise to collapse form assembly 10. Concrete box 40 can then more easily be removed.

Figure 3:
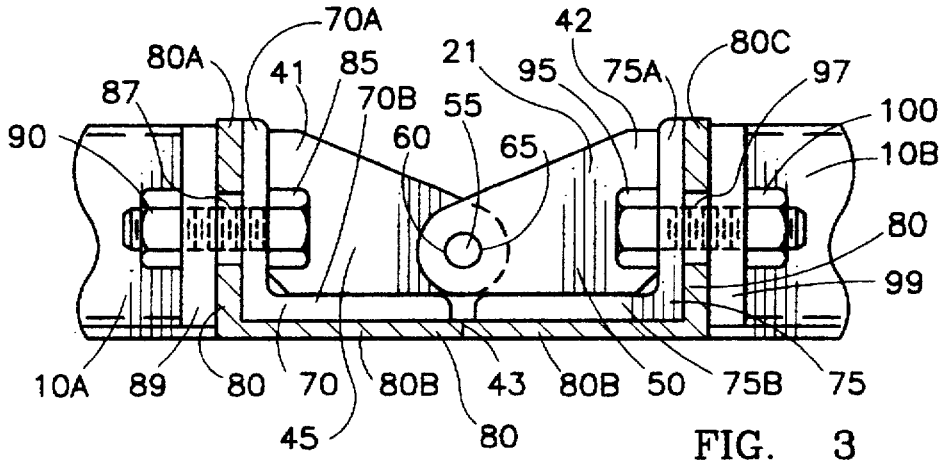
FIG. 3 is a close-up cross-sectional view of the hinge of FIG.'s 1 and 2 together with a portion of the adjacent form sections or panels to which the hinge is attached.

FIG. 3 is a close-up view of hinge 21 and a portion of the adjacent form sections or panels 10A and 10B to which hinge 21 is attached. Hinge 21 is representative of hinges 22, 23, 24, 25, 26, 27 and 28. In FIG. 3, hinge 21 is shown in cross section to more clearly portray the details of the hinge. Hinge 21 includes pivotally mating hinge brackets 41 and 42. Hinge brackets 41 and 42 are respectively connected to form sections 10A and 10B to permit sections 10A and 10B to pivot about hinge 21 as subsequently discussed in more detail. A joint 43 is formed at hinge 21 between form sections 10A and 10B.

Hinge brackets 41 and 42 respectively include hinge side elements 45 and 50 which are coupled to, and pivot about, pivot member 55. More specifically, hinge side elements 45 and 50 include respective axially aligned holes 60 and 65 through which pivot member 55 passes. In this manner, hinge brackets 41 and 42 pivot about pivot member 55 to permit form sections 10A and 10B to pivot about joint 43.

In more detail, hinge 21 further includes substantially L-shaped backing plates 70 and 75. Backing plates 70 and 75 are connected to hinge side elements 45 and 50 as shown by welding, brazing or other suitable mechanically connective technique. Alternatively, backing plate 70 is cast as a single integral part together with hinge side element 45, and similarly, backing plate 75 is caste as a single integral part together with hinge side element 50. In more detail, backing plate 70 includes substantially orthogonal leg portions 70A and 70B. Backing plate 75 includes substantially orthogonal leg portions 75A and 75B.

The exterior or outwardly facing surfaces of backing plates 70 and 75 are covered by a water tight gasket 80 as shown in FIG. 3. Gasket 80 exhibits a pliable shape which conforms to the shape of the L-shaped backing plates 70 and 75 on which it is situated. In the view of FIG. 3, gasket 80 includes gasket portion 80A which follows the contour of leg portion 70A. Gasket 80 further includes a central gasket portion 80B which follows the contour of leg portions 70B and 75B as shown. Finally, gasket 80 includes a gasket portion 80C which follows the contour of leg portion 75A. Various elastomeric waterproof materials can be used to fabricate gasket 80 such as, for example rubber and polyurethane. Gasket 80 prevents concrete or water from seeping into hinge 21 even when form sections 10A and 10B are pivoted about hinge 21. Gasket 80 advantageously flexes during such pivoting to maintain a water-tight seal at joint 43.

Form section 10A is held to backing plate 70 by a bolt 85 which passes through a common hole 87 in backing plate leg portion 70A, gasket portion 80A and an end 89 of form section 1OA. Bolt 85 is held in position by a tightened nut 90. In a similar manner, form section 10B is held to backing plate 75 by a bolt 95 which passes through a common hole 97 in backing plate leg portion 75A, gasket portion 80C and an end 99 of form section 10B.

Figure 4:
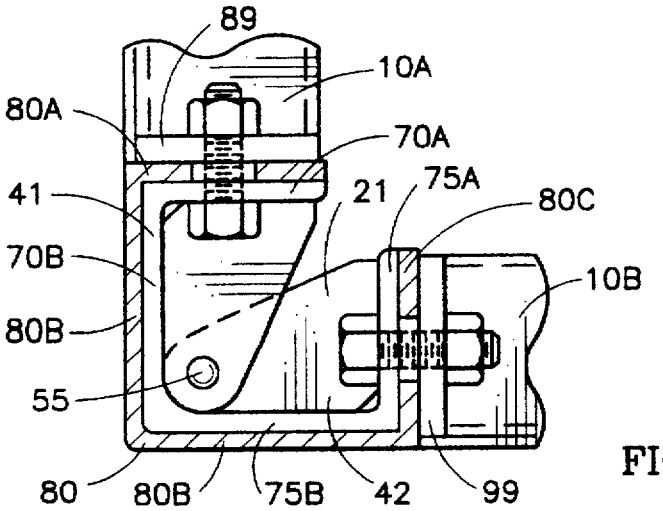
FIG. 4 is a cross sectional view which shows the hinge being rotated to form a right angle such that form sections attached to the hinge are perpendicular.

FIG. 4 is a cross sectional view of hinge 21 similar to the view of FIG. 3 except that hinge 21 is rotated to form a right angle such that form sections 10A and 10B are perpendicular. It is noted that, when hinge 21 is rotated in this manner, gasket 80 flexes and maintains a water-tight seal despite the rotation of the hinge.

Figure 5:
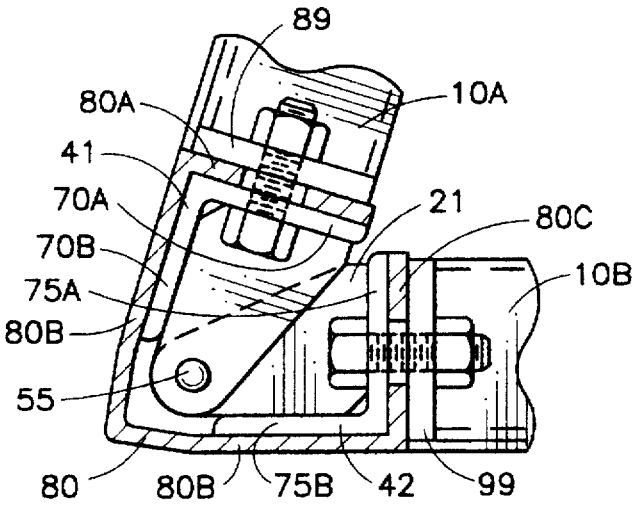
FIG. 5 is a cross sectional view of the hinge similar to the view of FIG. 4 except that the hinge is further rotated to form an acute angle so that the form sections likewise form an acute angle.

FIG. 5 is a cross sectional view of hinge 21 similar to the view of FIG. 4 except that hinge 21 is further rotated to form an acute angle such that form sections 10A and 10B likewise form an acute angle. Once again, when hinge 21 is rotated in this manner, gasket 80 flexes and maintains the watertight seal despite the substantial rotation of the hinge.

Figure 6:
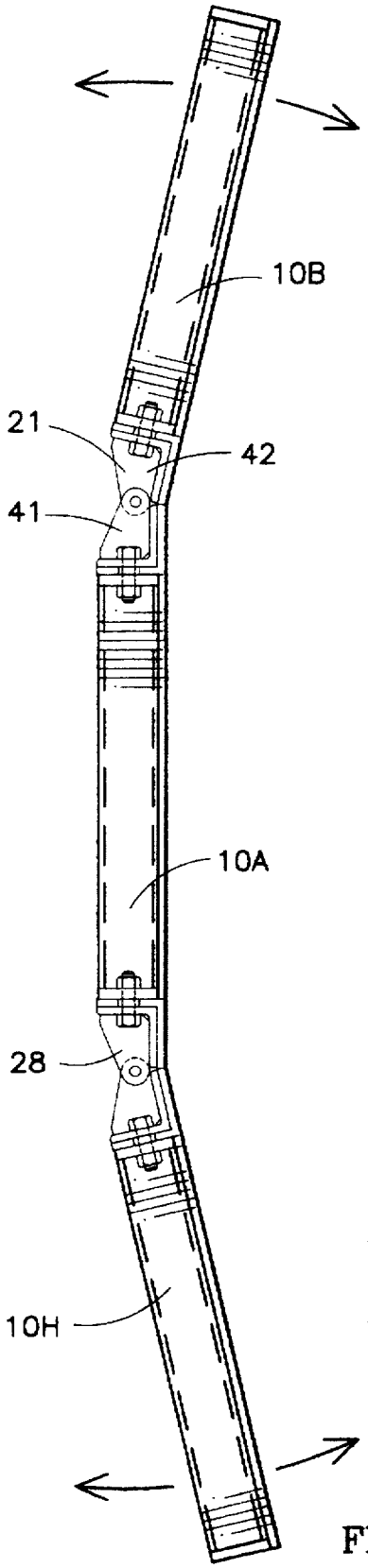
FIG. 6 is a cross-sectional view of adjacent form sections connected by the disclosed hinge showing the hinge rotated to an obtuse angle.

Hinge 21 can also be rotated to form an obtuse angle as demonstrated in FIG. 6. In FIG. 6, hinge 21 is shown connecting form sections 10A and 10B to permit such sections to pivot. Again the integrity of the water seal provided by flexible gasket 80 is maintained despite flexure of the gasket as hinge 21l rotates. This view also shows hinge 28 which connects form section 10H to form section 10A. It is noted that in this particular illustration, form sections 10H and 10A have not yet been positioned in the relative locations depicted in FIG. 1.

Figure 7:
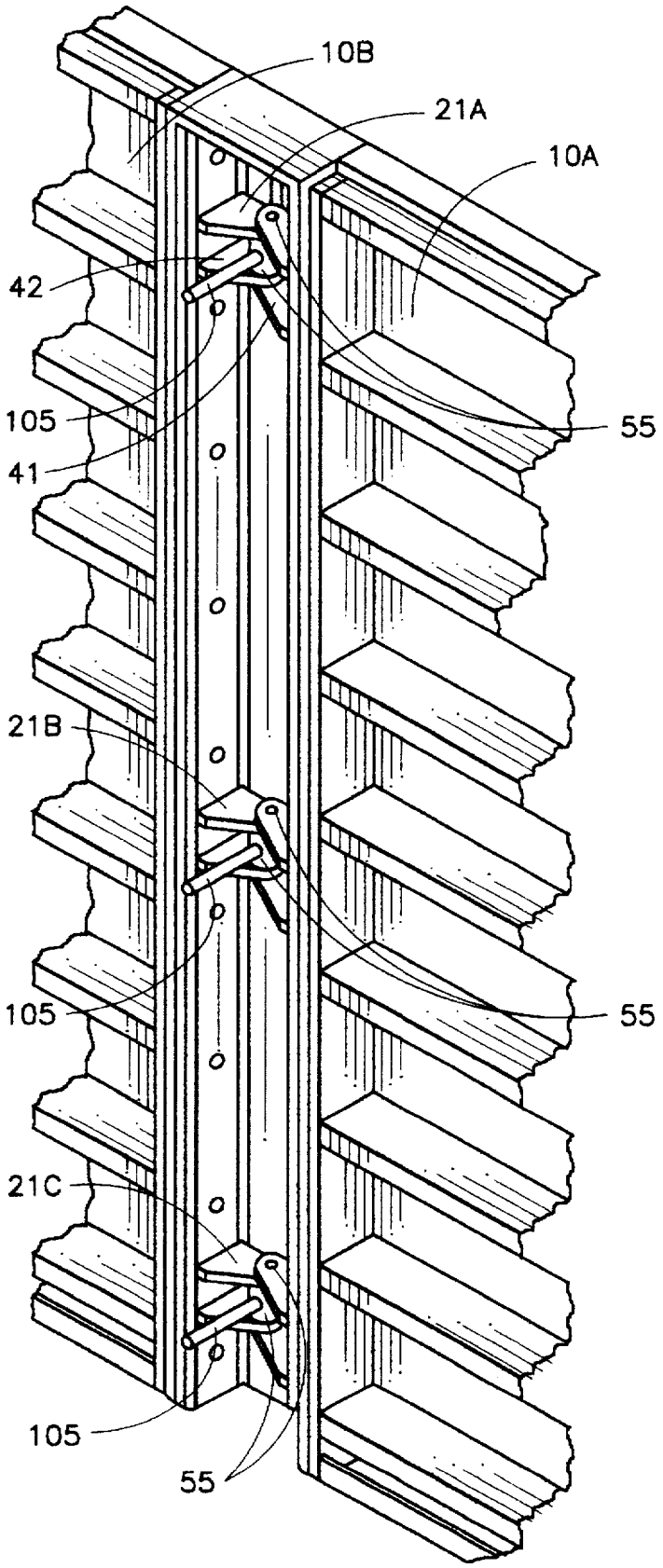
FIG. 7 is a more detailed perspective view of portions of adjacent form sections which are connected together by multiple hinges.

FIG. 7 is a perspective view of a portion of form sections 10A and 10B which are connected together by identical hinges 21 which are designated as hinges 21A, 21B and 21C. Hinge 21A connects form section 10A to form section 10B at the uppermost portions of these sections. Hinge 21B connects form section 10A to form section 10B at the middle portions of these sections. Hinge 21C connects form section 10A to form section 10B at the lowermost portions of these sections. In this particular embodiment, a cylindrical rod 105 is connected to pivot member 55 of the hinges and functions as the hinge opening and closing connecting rods 31-34.

Figure 8:
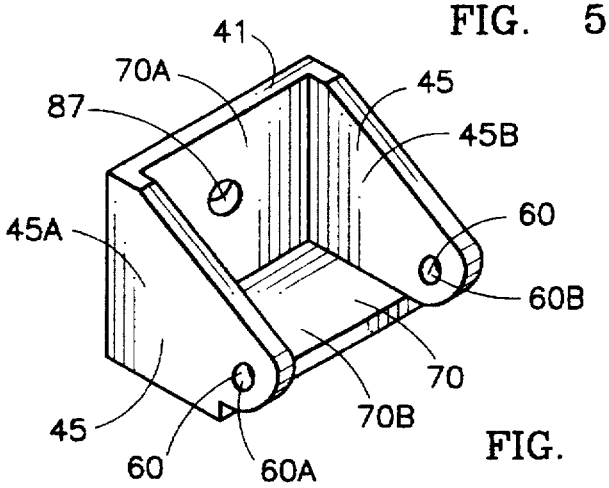
FIG. 8 is a perspective view of a hinge bracket of the disclosed hinge.

FIG. 8 is a simplified perspective view of hinge bracket 41. Hinge bracket 41 is formed in part by hinge side element 45 which includes hinge side elements 45A and 45B.Hinge side elements 45A and 45B are connected to one another by backing, plate 70 which is situated therebetween. In this manner, hinge side elements 45A and 45B are positioned in spaced apart relationship. Backing plate 70 is substantially L-shaped and includes substantially orthogonal leg portions 70A and 70B as shown. Hinge side elements 45A and 45B include respective axially aligned holes 60A and 60B as shown.

Figure 9:
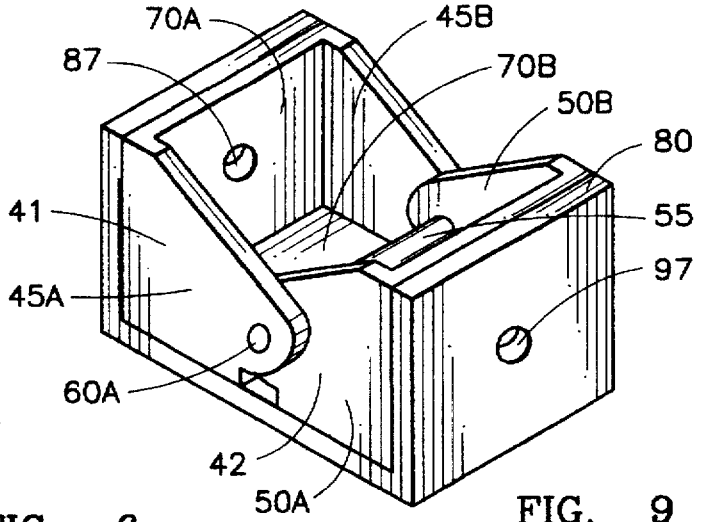
FIG. 9 is a perspective view of a completed hinge including a first hinge bracket pivotally mounted to a second hinge bracket and sealed by a gasket member.

FIG. 9 is a simplified perspective view of a completed hinge 21 including hinge bracket 41 pivotally mounted to hinge bracket 42 by pivot member 55. Hinge bracket 42 is similar to mating hinge bracket 41 except that hinge side elements 50A and 50B of hinge bracket 42 are positioned within hinge side elements 45A and 45B of hinge bracket 41. Gasket 80 is pliably formed around the exterior of hinge brackets 41 and 42 as shown to prevent water, concrete or other contaminants from entering the hinge.

The foregoing has described a leak resistant hinge which advantageously resists moisture and concrete penetration when the hinge is deployed to permit adjacent concrete form sections to pivot with respect to each other. The disclosed leak resistant hinge can be manufactured at low cost and advantageously requires little maintenance.

While only certain preferred features of the invention have been shown by way of illustration, many modifications and changes will occur to those skilled in the art. It is, therefore, to be understood that the present claims are intended to cover all such modifications and changes which fall within the true spirit of the invention.

What is claimed is:

1. A leak resistant hinge assembly comprising:

a pivot member;

a first hinge bracket including a first substantially L-shaped backing plate and first and second side hinge members; the first and second side hinge members being situated in spaced apart relationship and connected to the first backing plate, the first and second side hinge members including respective holes which are pivotally connected to the pivot member, the first backing plate including an interior surface and an exterior surface;

a second hinge bracket including a second substantially L-shaped backing plate and third and fourth side hinge members, the third and fourth side hinge members being situated in spaced apart relationship and connected to the second backing plate, the third and fourth side hinge members including respective holes which are pivotally connected to the pivot member, the second backing plate including an interior surface and an exterior surface; and a gasket member situated abutting the exterior surface of the first backing plate and the exterior surface of the second backing plate, such that the gasket member flexes adjacent the pivot member as the first and second hinge brackets rotate about the pivot member while the gasket seals the hinge from moisture penetration.

2. The leak resistant hinge of claim 1 wherein the first substantially L-shaped backing plate includes substantially orthogonal first and second leg portions, the first and second leg portions including a common first edge surface and a common second edge surface.

3. The leak resistant hinge of claim 2 wherein the first side hinge member is attached to the common first edge surface and the second side hinge member is attached to the common second edge surface such that the first side hinge member and the second side hinge member are held in substantially parallel spaced apart relationship.

4. The leak resistant hinge of claim 1 wherein the second substantially L-shaped backing plate includes substantially orthogonal third and fourth leg portions, the third and fourth leg portions including a common third edge surface and a common fourth edge surface.

5. The leak resistant hinge of claim 4 wherein the third side hinge member is attached to the common third edge surface and the fourth side hinge member is attached to the common fourth edge surface such that the third side hinge member and the fourth side hinge member are held is substantially parallel spaced apart relationship.

6. The leak resistant hinge of claim 1 wherein the respective holes of the first and second side hinge members are axially aligned to receive the pivot member therebetween.

7. The leak resistant hinge of claim 1 wherein the respective holes of the third and fourth side hinge members are axially aligned to receive the pivot member therebetween.

8. The leak resistant hinge of claim 1 wherein the third and fourth side hinge members are situated between the first and second side hinge members, the respective holes of the first, second, third and fourth side hinge members all being axially aligned to receive the pivot member.

9. A leak-proof, internally collapsible concrete form of the type including a plurality of hinge members interconnecting side panels of the form, each of the hinge members comprising a pair of generally L-shaped segments each having a first leg extending coextensively h a corresponding one of the side panels and a second leg extending generally normal to the corresponding side panel, each side panel having a normally extending flange for mating attachment to the second leg of a corresponding one of the hinge segments, an end of each first leg of each hinge segment being adapted for pivotable engagement with an end of a first leg of another hinge segment through a hinge pin to form one of the hinge members, the improvement comprising a gasket member extending over the first and second legs of each hinge segment of each hinge member, and having ends captured in compression between each second leg of each hinge segment and the mating flange of the corresponding side panel when the side panel is attached to the hinge segment, said gasket member forming a leak-proof connection between adjacent side panels covering each connecting hinge member.

* * * * *